United States Patent [19]

Ettischer et al.

[11] Patent Number: 5,046,717

[45] Date of Patent: Sep. 10, 1991

[54] DEVICE FOR COLLECTING SHEETS

[75] Inventors: Helmut Ettischer, Ostfildern; Ulrich Fischer, Kirchheim-Teck; Heinz Wagner, Wiesensteig, all of Fed. Rep. of Germany

[73] Assignee: Eastman Kodak Company, Rochester, N.Y.

[21] Appl. No.: 509,275

[22] Filed: Apr. 16, 1990

[30] Foreign Application Priority Data

May 29, 1989 [DE] Fed. Rep. of Germany ..... 3917373

[51] Int. Cl.[5] ..... B65H 31/14

[52] U.S. Cl. ..... 271/219; 271/220

[58] Field of Search ..... 271/219, 220, 224, 215, 271/217

[56] References Cited

U.S. PATENT DOCUMENTS

| | | | |
|---|---|---|---|
| 3,458,187 | 7/1969 | Draugelis | 271/219 |
| 4,350,333 | 9/1982 | Landa | 271/217 |
| 4,664,507 | 5/1987 | Fukae | 271/217 X |

FOREIGN PATENT DOCUMENTS

| | | | |
|---|---|---|---|
| 102755 | 6/1984 | Japan | 271/219 |
| 232367 | 11/1985 | Japan | 271/220 |
| 51456 | 3/1986 | Japan | 271/219 |
| 201768 | 9/1987 | Japan | 271/219 |
| 181672 | 7/1989 | Japan | 271/219 |

*Primary Examiner*—Richard A. Schacher

*Attorney, Agent, or Firm*—Lawrence P. Kessler

[57] ABSTRACT

A device for collecting sheets includes a collection tray (13) with a bottom portion (21) which forms a stack support surface (19). The bottom portion is movably arranged and is adjustable in response to the weight of the sheets (25) collected on the support surface (19). The support surface (19) is upwardly inclined in the sheet transport direction. A deflectable hold-down element (41) which intersects the imaginary trajectory of the sheets and urges the deposited sheets (25) downwardly, is provided for cooperation with the rear area of the sheets (25) to be collected.

7 Claims, 2 Drawing Sheets

DEVICE FOR COLLECTING SHEETS

BACKGROUND OF THE INVENTION

The invention relates to a device for collecting sheets, such device having a receiving tray to which the sheets that are moved in a direction of transport along an at least approximately horizontal portion of an imaginary trajectory can be fed individually, and a movably mounted bottom portion of the receiving tray. The bottom portion of the tray, having an adjusting element for adjusting the position, is upwardly inclined toward the horizontal in the direction of transport and intersects the imaginary trajectory.

Trays for collecting sheets transported along a path are generally well known, see e.g. U.S. Pat. No. 4,350,333, issued Sept. 21, 1982, in the name of Landa. Such patent discloses a device in the form of a stacking means for copy sheets, in particular copy sheets fed by a copier. Typical copiers or printing systems operate at a relatively high speed, i.e., the sheets are fed at a relatively high frequency rate, which automatically leads to a correspondingly high speed at which the sheets are transported to the collection tray. Due to the high speed at which the sheets move along the trajectory before reaching the collection tray, the collecting process itself is inaccurate. This is because the support surface of the tray is upwardly inclined in the direction of transport in order to slow the sheets down. The individual sheets are deposited on top of each other with a degree of lateral offset. In high speed copiers or printing systems, the formation of stacks whose sheets are in alignment is of utmost importance. This is particularly the case if the device concerned has a collection tray shiftable in the horizontal plane transversely to the direction of transport, and if the stacks which consist of aligned sets of sheets are to be deposited on top of each other with a predetermined specified lateral displacement.

In the aforementioned patent, the individual sheets are prevented from being laterally displaced by the adjusting element for the bottom portion of the collection tray being controlled by an electric sensing and driving device. Accordingly, irrespectively of how thick the stack of sheets is which rests on the bottom portion, the sheets always drop from substantially the same height. The electric sensing and driving device renders the apparatus much more complicated and, thus, results in an increase in production costs.

SUMMARY OF THE INVENTION

It is the object of the invention to provide a device for collecting sheets such that, although this device can be manufactured in a particularly simple and inexpensive way, the sheets are collected in alignment, i.e., without being offset. This object is attained in accordance with the invention in that the position of the bottom portion of the collection device is controllable by the weight of the sheets deposited, and the position can be adjusted in response to the volume of the sheet stack resting on the bottom portion. As such, the device according to the invention has a much simpler construction than known apparatus because the sensing and driving device required for adjusting the position of the bottom portion of known apparatus can be omitted.

Further, the precision with which the sheets are collected can be improved by a deflectable hold-down element located adjacent to the lower end of the sheet support surface intersecting the imaginary trajectory of the sheets. The hold-down element acts on the rear area of a sheet (seen in the direction of transport) and ensures that when a sheet is released for collection, the rear area of the sheet is not lowered in a freely floating manner onto the support surface formed by the bottom portion or the topmost sheet of a stack of sheets already deposited, but is urged downwardly by a hold-down force. Consequently, the air cushion formed in the rear sheet area between the support surface and the lower face of the sheet is displaced when the sheet glides along the upwardly inclined support surface with its front area only while not yet contacting such surface with its rear area. The effect resulting from known devices, namely that the air cushion below the sheet leads to a lateral displacement of the rear sheet area, is avoided with the invention because the hold-down element urges the rear sheet area downwardly in a well-defined manner.

The costs and the additional expense for manufacturing the hold-down element are extremely low. Very good results can even be achieved by giving the hold-down element the simplest configuration possible, e.g., by producing at least one hold-down finger which consists of a resilient material which can be deflected out of the trajectory by bending. Preferably, the hold-down finger is made of plastic. Despite the fact that the collection tray according to this invention uses the hold-down element, the collection tray has a much simpler construction and can, therefore, be produced at less cost than known devices.

The element for adjsuting the position of the bottom portion of the collection tray in response to the weight of the sheet stack can be constructed in a particularly simple manner. For example, the bottom portion can be mounted so as to be pivotable about a journal in the area of its higher end, the longitudinal axis of such journal extending at least substantially horizontally with respect to the direction in which the sheets are transported and located vertically above the sheet transport trajectory. A spring arrangement in engagement with the bottom portion of the collection tray acts like a spring balance and can produce a torque about the journal which counteracts the torque produced by the influence of the weight of the bottom portion and the sheets resting thereon.

The invention, and its objects and advantages, will become more apparent in the detailed description of the preferred embodiment presented below.

BRIEF DESCRIPTION OF THE DRAWINGS

The invention will be explained with reference to an embodiment illustrated in the accompanying drawings in which.

DESCRIPTION OF THE PREFERRED EMBODIMENT

Figure 1:
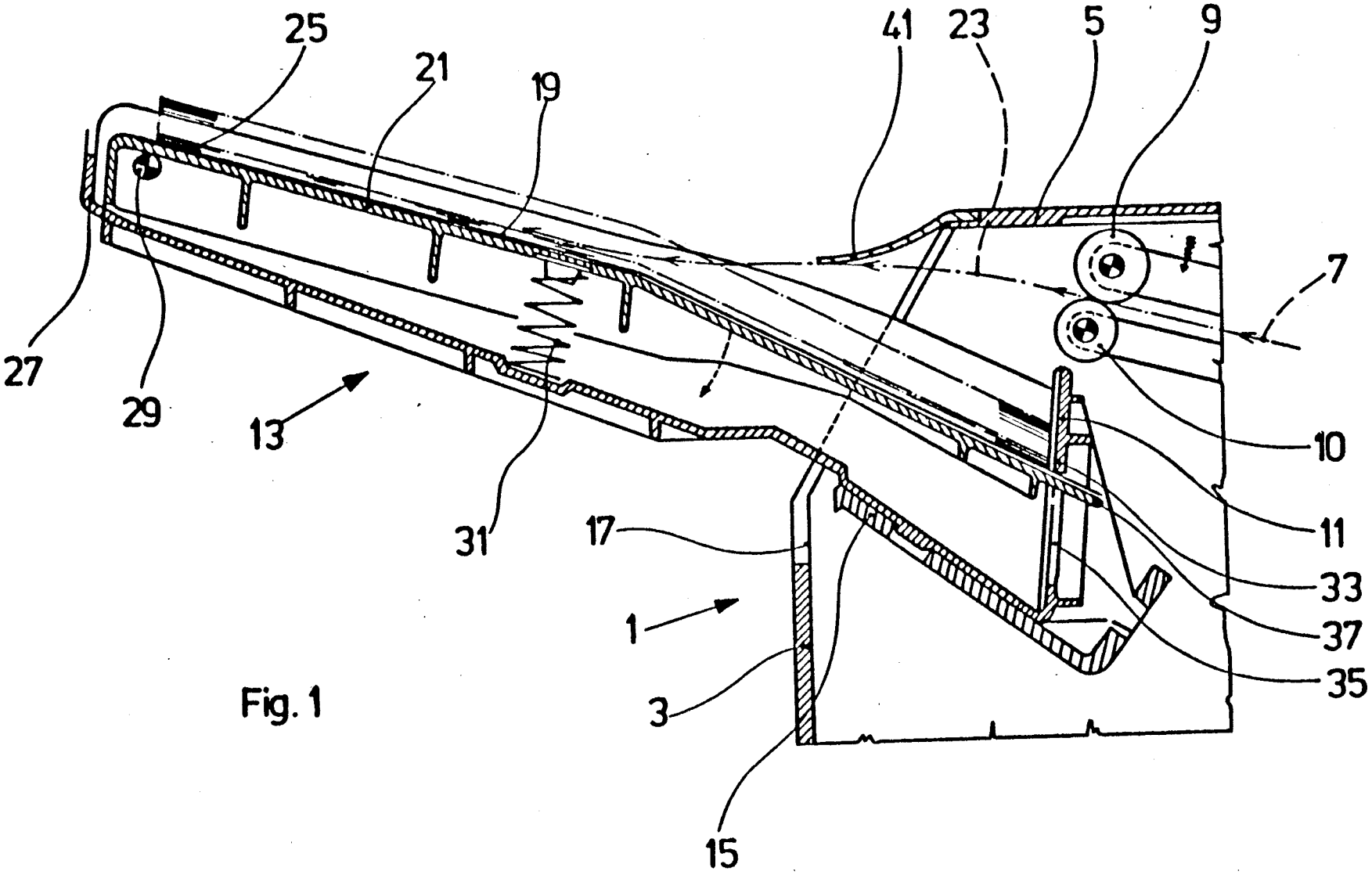
FIG. 1 is a longitudinally sectional view of an embodiment of the device for collecting sheets in accordance with this invention with parts broken away.

Referring to the accompanying drawings, the device for collecting sheets according to this invention includes a housing 1 of which only a front end wall 3 and an upper wall 5 forming the lid of the housing can be seen in the figures. With its rear end wall (not illustrated) which faces away from the front end wall 3, the housing 1 can be attached to an apparatus (not shown)

which is associated therewith and from which individual sheets exit one after the other, e.g., a copier, a printing system or any other apparatus in which sheets of paper are processed and/or handled. The sheets which enter the housing 1 at the rear end wall are advanced in a direction indicated by an arrow 7 by means of drivable upper and lower transport rollers 9 and 10, respectively, which are spring-biased into contact with each other. The transport rollers 9, 10 are arranged in the vicinity of the upper wall 5 of the housing and above a rear side wall 11 of a sheet collection tray denoted 13 in its entirety. The transport rollers 9, 10 may be designed as sheet stiffening rollers known from sheet transport devices.

The collection tray 13 is inserted in a tray holder 15 which is arranged in housing 1 and into which the rear area of tray 13 is received. That area of tray 13 which extends away from the rear area in the direction of sheet transport, projects out of the housing 1 through a front opening 17. This opening 17 is broader than the depositing tray 13, see FIG. 2, so that when a tray holder 15 is used which is horizontally movable transverse to the sheet transport direction, the collection tray 13 is able to carry out a restricted lateral movement in the opening 17 of housing 1. As will be explained in the following, this arrangement allows sheets or sheet stacks to be collected in the tray 13, which are laterally displaced with respect to each other in a specified desired manner.

The collection tray 13 has a bottom portion 21 whose upper side takes the shape of a plane slightly bent downwardly in its rear area and which, together with that upper side, forms a stack support surface 19. The stack support surface 19 is inclined toward the horizontal plane with the inclination rising in the sheet transport direction. As can best be seen from FIG. 1, support surface 19 is inclined and arranged relative to the transport rollers 9, 10 such that the sheets transported by rollers 9, 10 and ejected by such rollers along an approximately horizontal trajectory 23, are more or less tangently received on the support surface 19 or on the upper face of sheets 25 that may already be collected on such surface, and glide upwardly. The downwardly bent plane of the rear part of support surface 19 leads to the sheet stack in that area resting always below the transport rollers 9, 10 to such an extent that the fed sheets can be collected without being hindered.

The bottom portion 21 of the collection tray 13 is movably mounted in a tray housing 27. The bottom portion 21 is pivotally mounted about a pivot axis which is defined on the bottom portion 21 by lateral journals 29 and extends horizontally with respect to the sheet transport direction (arrow 7). The pivot axis is located vertically above the sheet transport trajectory 23. Seen in the direction of sheet transport, the axis defined by journals 29 extends at the front end section of bottom portion 21 and the support surface 19 formed by such portion. A helical pressure spring 31 is provided approximately in the middle between the pivotal axis (journals 29) and the rear side wall 11 which forms an integral part with tray housing 27, and is mounted between the lower side of bottom portion 21 and that wall of the tray housing 27, which faces the bottom portion.

In view of the leverage conditions caused by the journals 29 of the bottom portion 21 as well as by the weight and the overall dimensions of such portion, the force and the load deflection curve of the pressure spring 31 have been chosen in a manner analogous to that known from spring balances. Accordingly, when a stack of sheets 25 is formed which rests on the support surface 19, the bottom portion 21 pivots downwardly in opposition to the force of pressure spring 31 to such an extent that independently of the stack height, the trajectory 23 of the sheets 25 approaches the topmost sheet 25 tangently in a manner similar to the one in which the first sheet 25 approaches the support surface 19 when said surface is not spring-loaded. These conditions can be easily calculated and/or tested by a person skilled in the art. In other words, the abutment surface formed by the support surface 19 or the topmost sheet 25 of a stack of sheets is always in a position relative to the trajectory, which ensures that each newly fed sheet 25 is collected in a perfect way, with the height from which the rear sheet section drops downwardly being substantially the same.

The upper end position which the bottom portion 21 assumes when no sheet 25 is collected thereon is defined by a stop. The stop has a surface 33 which is formed by the upper end of a slot opening 35 in side wall 11, the opening being engaged by a rear attachment 37 of bottom portion 21.

A hold-down element is provided at a point of the trajectory 23 approximately in the middle between the transport rollers 9, 10 and that point where the sheets 25 come to rest on the support surface 19 (or the upper side of the sheets 25 already deposited). In the illustrated embodiment, the hold-down element consists of three fingers 41 made of a resilient plastic material. The fingers 41 are respectively attached at one end to the upper wall 5 of the housing 1, such as by bonding, for example. It is obvious that the hold-down fingers 41 could also be attached to wall 5 in a different manner, e.g., by means of a clamp or screw connection. The hold-down fingers 41 are evenly spaced across the width of the collection tray 13 (see FIG. 2) and intersect the imaginary trajectory 23 of the sheets 25. The fact that the sheets 25 moving in the direction of transport engage the hold-down fingers 41, causes such fingers to be deflected or bent away from their normal positions in which they are suspended from wall 5. This can be seen from FIG. 1 which shows how the sheets 25 moving along the trajectory 23 engage fingers 41. When in their deflected positions, the hold-down fingers 41 exert a pressure on the upper face of the sheet concerned, which corresponds to about 3.5 cN.

When the sheets 25 are transported along trajectory 23, as mentioned before, the sheets come to rest with their front areas on an upwardly inclined support surface 19 or on the upper side of a sheet 25 or a stack of sheets 25 collected there already. Due to the fact that the position of the bottom portion 21 is changed in opposition to the force of pressure spring 31 in response to weight of the sheets on the bottom portion, the sheets are always collected in a perfect way. That is, the sheets glide upwardly with their front areas along the inclined surface supporting them. The hold-down force which fingers 41 produce on the rear sheet area causes such area to be pressed downwardly. Thus, the air cushion below such rear sheet area is displaced so that the rear part of sheets 25 is also deposited in a perfect way. The sheets fed in the direction of transport 7 are stabilized by the sheet stiffening rollers 9, 10 such that the hold-down fingers 41 resting on the sheets have no negative influence on the trajectory 23 of the sheets. Only when the rear end of a sheet has left the stiffening rollers 9, 10 do the hold-down fingers 41 urge the rear sheet area downwardly in the manner described.

Figure 2:
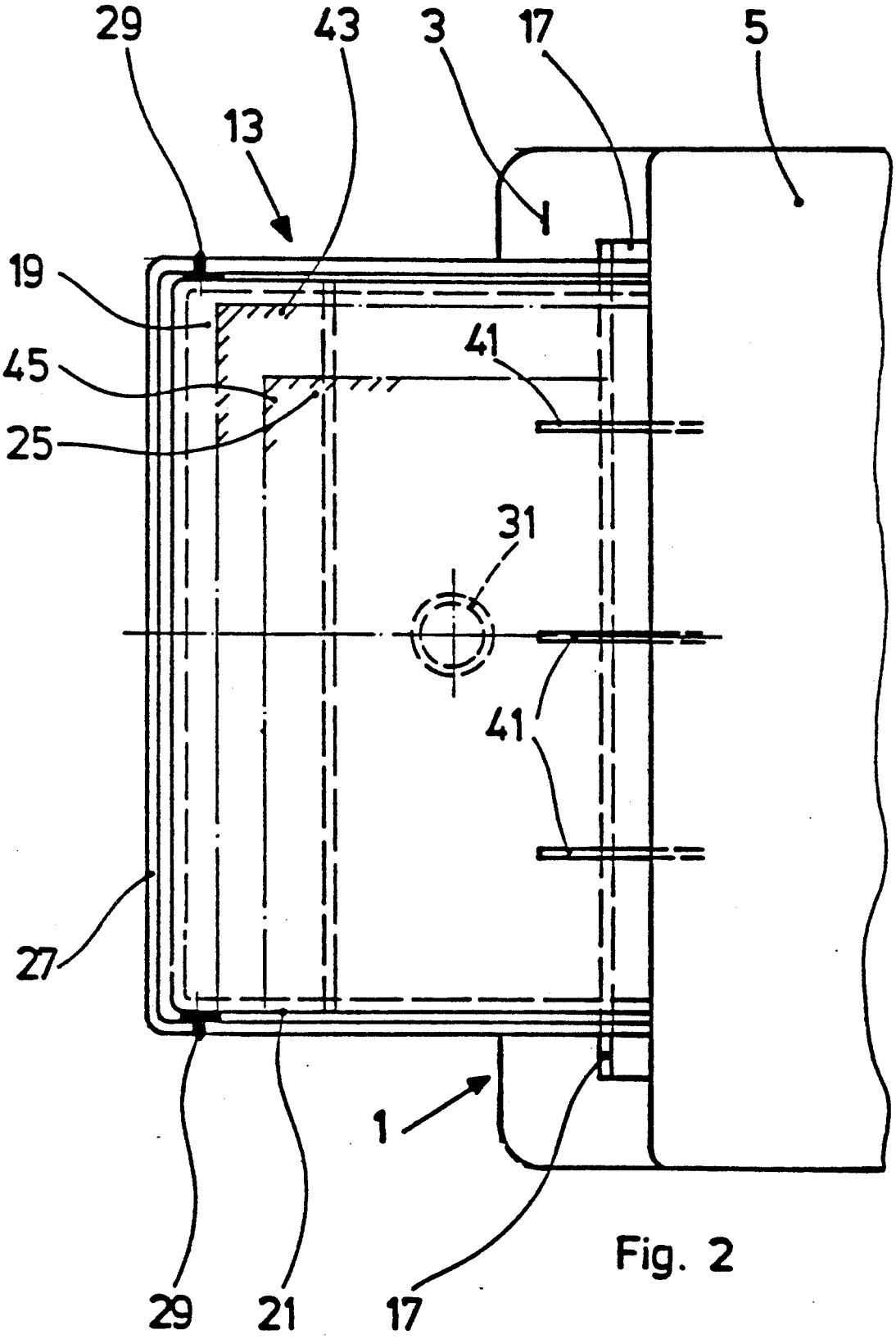
FIG. 2 is a plan view of a portion of the device according to FIG. 1 at a slightly smaller scale.

In the above described manner, successively fed sheets 25 come to rest on support surface 19 without being laterally offset, i.e., stacks can be formed which are in perfect alignment. FIG. 2 shows two stacks 43 and 45 of different formats, i.e., stacks of sheets which have different sizes. When identical sheet formats are used, stacks which consists of sets of sheets 25 can be distinguished in that individual stacks corresponding to sets of sheets are respectively collected so as to be offset with respect to each other. Such offset is affected by shifting the collection tray 19 within the opening 17 in either direction by a shifting movement of the tray holder 15. Shifting takes place between collection of the sets of sheets. As the device according to the invention allows the sheets 25 to be deposited in perfect alignment, the stacks consisting of individual sets of sheets are offset such that they can be easily identified or handled.

The above description and the drawings are restricted to features which are essential for describing an embodiment of the invention. Inasmuch as features are revealed in the description and in the drawings but not referred to in the claims, they also serve, if necessary, for defining the subject matter of the invention.

We claim:

1. Device for collecting sheets, said collecting device comprising:

means (9, 10) for moving sheets (25) in a direction of transport (7) along an at least approximately horizontal portion of an imaginary trajectory (23); and a collection tray (13) to which sheets (25) that are moved by said moving means can be fed individually, said collection tray including a movably mounted bottom portion (21) upwardly inclined toward the horizontal in the direction of transport (7) and intersecting the imaginary trajectory (23), an adjusting element for adjusting the position of said bottom portion (21), said adjusting element controllable by weight of the sheets (25) collected on said bottom portion (21), said adjusting element including a journal (29) associated with said bottom portion (21), said journal extending at least substantially horizontally relative to the direction of transport (7) of sheets (25) and located vertically above the imaginary trajectory (23), said bottom portion (21) being pivotally mounted on said journal in the area of its higher end, and a deflectable hold-down element provided adjacent to the lower end of bottom portion (21) intersecting the imaginary trajectory (23).

2. Device according to claim 1, wherein said adjusting element further includes a spring arrangement whose force acts on said bottom portion (21) for producing a torque about journal (29), said torque counteracting the torque produced by weight of sheets (25) collected on said bottom portion.

3. Device according to claim 2, wherein said spring arrangement includes at least a helical pressure spring (31) on which the lower side of said bottom portion (21) rests at a point between said journal (29) and the lower end of the sheet support surface (19) of said bottom portion.

4. Device according to claim 2, wherein a stop (33) is provided which limits pivotal movement of said bottom portion (21) in an upper position; said movement being caused by the force of said spring arrangement.

5. Device according to claim 4, wherein said stop (33) is configured at a rear side wall (11) of said collection tray (13), said side wall limiting said collection tray (13) at the lower end of said sheet support surface (19).

6. Device according to claim 1, wherein said hold-down element has at least one hold-down finger (41) which is made of a resilient material so that it can be deflected out of the trajectory (23) by bending when engaged by a sheet (25).

7. Device according to claim 6, including a plurality of hold-down fingers (41), said fingers being across the width of said sheet support surface (19).

* * * * *